US012799412B2

(12) United States Patent
Raja et al.

(10) Patent No.: US 12,799,412 B2
(45) Date of Patent: Nov. 17, 2026

(54) PROCESS FOR UPGRADATION OF CRACKED RESIDUAL HYDROCARBONS

(71) Applicant: Hindustan Petroleum Corporation Limited, Bengaluru (IN)

(72) Inventors: Kanuparthy Naga Raja, Bengaluru (IN); Satyanarayana Murty Pudi, Bengaluru (IN)

(73) Assignee: Hindustan Petroleum Corporation Limited, Bengaluru (IN)

( * ) Notice: Subject to any disclaimer, the term of this patent is extended or adjusted under 35 U.S.C. 154(b) by 164 days.

(21) Appl. No.: 18/816,045

(22) Filed: Aug. 27, 2024

(65) Prior Publication Data

US 2025/0283003 A1 Sep. 11, 2025

(30) Foreign Application Priority Data

Mar. 7, 2024 (IN) ..... 202441016306

(51) Int. Cl.
*C10G 65/18* (2006.01)
*C10G 47/26* (2006.01)

(52) U.S. Cl.
CPC ..... *C10G 65/18* (2013.01); *C10G 47/26* (2013.01); *C10G 2300/1077* (2013.01); *C10G 2300/206* (2013.01); *C10G 2300/301* (2013.01); *C10G 2300/4006* (2013.01); *C10G 2300/4012* (2013.01); *C10G 2300/4018* (2013.01); *C10G 2300/4025* (2013.01); *C10G 2300/4081* (2013.01); *C10G 2300/701* (2013.01); *C10G 2300/708* (2013.01); *C10G 2300/802* (2013.01)

(58) Field of Classification Search
CPC ..... C10G 65/18; C10G 47/26; C10G 2300/1077; C10G 2300/206; C10G 2300/301; C10G 2300/4006; C10G 2300/4012; C10G 2300/4018; C10G 2300/4025; C10G 2300/4081
See application file for complete search history.

(56) References Cited

U.S. PATENT DOCUMENTS

| | | | | |
|---|---|---|---|---|
| 10,195,588 | B1 * | 2/2019 | Do | C10G 47/12 |
| 2014/0034549 | A1 * | 2/2014 | Mukherjee | C10G 65/12 422/187 |
| 2017/0058212 | A1 * | 3/2017 | Kumar | B01J 35/27 |
| 2017/0128929 | A1 * | 5/2017 | Kumar | B01J 37/086 |
| 2018/0051219 | A1 * | 2/2018 | Do | C10G 47/12 |
| 2019/0144766 | A1 * | 5/2019 | Yokomizo | C10G 65/10 208/78 |
| 2022/0204877 | A1 * | 6/2022 | Sangalli | C10G 67/14 |

(Continued)

FOREIGN PATENT DOCUMENTS

| | | | | |
|---|---|---|---|---|
| WO | WO-2014120490 | A1 * | 8/2014 | C10G 1/06 |
| WO | WO-2018055520 | A1 * | 3/2018 | C10G 67/02 |

*Primary Examiner* — Ellen M McAvoy
(74) *Attorney, Agent, or Firm* — BLANK ROME LLP

(57) ABSTRACT

The present invention relates to a process for upgradation of cracked residual hydrocarbons. More specifically, the present invention relates to a process for upgradation of cracked residual hydrocarbons into distillates in the presence of a catalyst in a slurry hydrocracking reactor (7). The slurry hydrocracking reactor (7) maximizes the conversions of hydrocarbons to distillate products and reduces the bottom unconverted fraction. The slurry hydrocracking reactor (7) enhances residue conversions to greater than 97% with reduced purge.

19 Claims, 1 Drawing Sheet

(56) References Cited

U.S. PATENT DOCUMENTS

| | | | | |
|---|---|---|---|---|
| 2022/0325189 | A1* | 10/2022 | Shen | C10G 21/003 |
| 2022/0348832 | A1* | 11/2022 | Ayar | C10G 65/10 |
| 2025/0084324 | A1* | 3/2025 | Koseoglu | C10G 45/02 |
| 2025/0283001 | A1* | 9/2025 | Raja | C10G 47/06 |

* cited by examiner

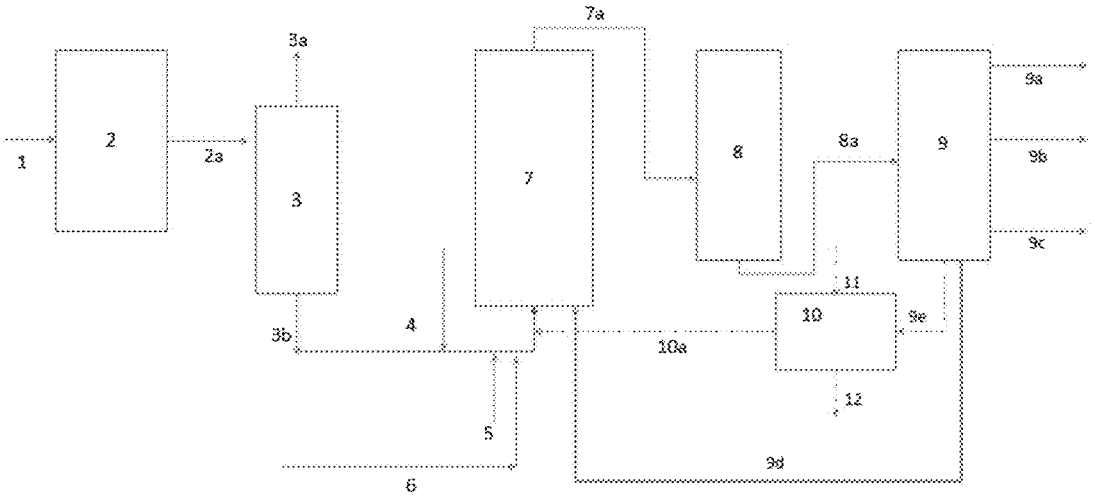
1
2
2a
3
3a
3b
4
5
6
7
7a
8
8a
9
9a
9b
9c
9d
9e
10
10a
11
12

PROCESS FOR UPGRADATION OF CRACKED RESIDUAL HYDROCARBONS

RELATED APPLICATION

This application claims priority to Indian Application No. 202441016306, filed Mar. 7, 2024. The contents of this application are hereby incorporated by reference in its entirety.

FIELD OF THE INVENTION

The present invention relates to a process for upgradation of cracked residual hydrocarbons. More specifically, the present invention relates to a process for upgradation of cracked residual hydrocarbons into distillates in a slurry hydrocracking reactor (7).

BACKGROUND OF THE INVENTION

The light fossil crude oils reserves have been diminished over a period of time and the demand for light distillates are increasing. Heavy crude oils and extra heavy oils yield 30-60% residual hydrocarbons, and this compels the industry to adopt resid upgradation technologies in refinery or crude to chemicals domain to produce more distillates and petrochemical precursors. In this scenario, more efficient upgrading technologies for converting heavy hydrocarbons into light fuels is essential.

Ebullated bed resid hydrocracking is one of the technologies that converts heavy hydrocarbons directly into marketable lighter molecules. The catalyst is kept in an ebullated state through the upward lift of heavy hydrocarbons under hydrogen rich atmosphere. The catalyst extrudates in expanded state is controlled by liquid recycle rate by using product stream. These units are to be operated at moderate conversions, as increasing conversions beyond the optimum for the given feedstock tend to form sediment and coke precursors in the unit. This leads to increased fouling in the downstream equipment. At 70% to 80% vacuum resid conversion, the unconverted heavy portion typically is used for making low value Bitumen or Fuel Oil. Higher the conversion, better the process economics is. However, the conversions are limited due to presence of high concentration of asphaltenes in the unconverted portion of hydrocracked vacuum residue. In order to achieve higher conversions of feed and light product yields, different combination thermal-catalytic, catalytic-catalytic, and extraction-catalytic conversion technologies shall be required.

Therefore, there is a requirement of a process for the efficient conversion of unconverted residual hydrocarbon resulting from partial conversions in hydrocracking process that would benefit the overall process by converting into lighter distillates there by reducing pitch yield.

SUMMARY OF THE INVENTION

This summary is provided to introduce a selection of concepts, in a simplified format, that are further described in the detailed description of the invention. This summary is neither intended to identify key or essential inventive concepts of the invention and nor is it intended to determine the scope of the invention.

The present invention provides a process for upgradation of cracked residual hydrocarbons, wherein the process comprises the steps of:

i. hydrocracking a feed stream (1) in a primary conversion unit (2) to obtain a mix of a hydrocracked residual hydrocarbon stream and a lighter hydrocarbon stream (2*a*), wherein the feed stream is a vacuum residue stream;

ii. sending the mix of the hydrocracked residual hydrocarbon and the lighter hydrocarbon stream (2*a*) into a fractionator (3) to recover a lighter hydrocarbon fraction (3*a*) and a hydrocracked vacuum resid fraction (3*b*);

iii. mixing the hydrocracked vacuum resid fraction (3*b*) with a diluent (6) in the presence of hydrogen (4) and a catalyst (5) to form a mixed feed stream, wherein the catalyst is dispersed in the mixed feed stream;

iv. processing the mixed feed stream in a secondary conversion unit to obtain a stream of liquid effluents and vapour effluents, wherein the secondary conversion unit is a slurry hydrocracking reactor (7);

v. sending the stream of liquid effluents and vapor effluents into a separator (8) to separate liquid effluents from vapour effluents;

vi. sending the liquid effluents to a fractionation column (9) to separate a lighter distillate (9*a*), a middle distillate (9*b*), a vacuum gas oil (9*c*) an unconverted slurry hydrocracked pitch residue (9*d*) and a slurry hydrocracked bottom pitch (9*e*), wherein the middle distillates are kerosene and diesel;

vii. recycling the unconverted slurry hydrocracked pitch residue (9*d*) to the slurry hydrocracking reactor (7), wherein the unconverted slurry hydrocracked pitch residue (9*d*) comprises the catalyst.

OBJECTIVES OF THE PRESENT INVENTION

The main objective of the present invention is to provide a process for the upgradation of cracked residual hydrocarbons into distillates.

Another objective of the present invention is to provide a process for the enhanced conversion of cracked residual hydrocarbons.

BRIEF DESCRIPTION OF THE DRAWINGS

FIG. 1 depicts a schematic flow diagram showing the process and apparatus for the upgradation of cracked residual hydrocarbons into distillates.

DETAILED DESCRIPTION OF THE INVENTION

For the purpose of promoting an understanding of the principles of the invention, reference will now be made to the embodiments in the specific language will be used to describe the same. It will nevertheless be understood that no limitation of the scope of the invention is thereby intended, such alterations and further modifications in the illustrated process, and such further applications of the principles of the invention as illustrated therein being contemplated as would normally occur to one skilled in the art to which the invention relates. Unless otherwise defined, all technical and scientific terms used herein have the same meaning as commonly understood by one of ordinary skilled in the art to which this invention belongs. The composition, methods, and examples provided herein are illustrative only and not intended to be limiting.

The articles "a", "an" and "the" are used to refer to one or to more than one (i.e., to at least one) of the grammatical object of the article.

The terms "comprise" and "comprising" are used in the inclusive, open sense, meaning that additional elements may be included. It is not intended to be construed as "consists of only".

Throughout this specification, unless the context requires otherwise the word "comprise", and variations such as "comprises" and "comprising", will be understood to imply the inclusion of a stated element or step or group of element or steps but not the exclusion of any other element or step or group of element or steps.

Unless defined otherwise, all technical and scientific terms used herein have the same meaning as commonly understood by one of ordinary skill in the art to which this disclosure belongs. Although any methods and materials similar or equivalent to those described herein can be used in the practice or testing of the disclosure, the preferred methods and materials are now described. All publications mentioned herein are incorporated herein by reference.

The terminology and structure employed herein is for describing, teaching, and illuminating some embodiments and their specific features and elements and does not limit, restrict, or reduce the spirit and scope of the invention.

The slurry-phase hydrocracking is a promising process for converting heavy hydrocarbon feedstocks with high impurities such as atmospheric resid, vacuum resid, tar sands bitumen, heavy coker gas oils, partially hydrocracked heavy hydrocarbons, hydrocarbons that boil above 400° C. characterized by high Conradson Carbon Number, Asphaltenes, metals, sulfur, etc., such as but not limited to asphaltenic pitch from solvent extraction unit, delayed coker, mild resid hydrocracker, Pyrolysis oils, etc., to high value lower boiling products. In slurry-phase hydrocracking, the catalyst is in dispersed phase. The main functions of the dispersed catalyst are promoting hydroconversion through hydrocracking by using active hydrogen and suppressing coke formation. In the slurry-phase hydrocracking, the liquid feed stocks are mixed with hydrogen and dispersed catalyst, wherein the dispersed catalyst have high active surface area which actively participates in asphaltene hydrocracking reactions.

Therefore, the present invention provides a process for the upgradation of unconverted residual hydrocarbon resulting from partial conversions. The slurry hydrocracking process converts the unconverted residual hydrocarbon into lighter distillates there by reducing pitch yield.

In an embodiment the present invention provides a schematic flow diagram depicting the process and the apparatus of the present invention for the conversion of vacuum residue (1) having a boiling point of 500° C. or above in a primary conversion unit and then in a secondary conversion unit as shown in FIG. 1.

The present invention provides a process for upgradation of cracked residual hydrocarbons, wherein the process comprises the steps of:

i. hydrocracking a feed stream (1) in a primary conversion unit (2) to obtain a mix of a hydrocracked residual hydrocarbon stream and a lighter hydrocarbon stream (2*a*), wherein the feed stream is a vacuum residue stream;

ii. sending the mix of the hydrocracked residual hydrocarbon and the lighter hydrocarbon stream (2*a*) into a fractionator (3) to recover a lighter hydrocarbon fraction (3*a*) and a hydrocracked vacuum resid fraction (3*b*);

iii. mixing the hydrocracked vacuum resid fraction (3*b*) with a diluent (6) in the presence of hydrogen (4) and a catalyst (5) to form a mixed feed stream, wherein the catalyst is dispersed in the mixed feed stream;

iv. processing the mixed feed stream in a secondary conversion unit to obtain a stream of liquid effluents and vapour effluents, wherein the secondary conversion unit is a slurry hydrocracking reactor (7);

v. sending the stream of liquid effluents and vapor effluents into a separator (8) to separate liquid effluents from vapour effluents;

vi. sending the liquid effluents to a fractionation column (9) to separate a lighter distillate (9*a*), a middle distillate (9*b*), a vacuum gas oil (9*c*) an unconverted slurry hydrocracked pitch residue (9*d*) and a slurry hydrocracked bottom pitch (9*e*), wherein the middle distillates are kerosene and diesel;

vii. recycling the unconverted slurry hydrocracked pitch residue (9*d*) to the slurry hydrocracking reactor (7) wherein the unconverted slurry hydrocracked pitch residue (9*d*) comprises the catalyst.

Further, the process as disclosed herein includes step of sending the slurry hydrocracked bottom pitch (9*e*) to a catalyst recovery unit (10). In the said catalyst recovery unit (10) the slurry hydrocracked bottom pitch (9*e*) is mixed with a diluent to separate a recovered hydrocarbon stream containing recycled catalyst (10*a*) from a high dense material/purge.

The high dense material consist of very heavy hydrocarbon includes asphaltenes, metals, and a coke precursor. Further, the diluent is selected from clarified oil, vacuum gas oil (VGO), cycle oil, and aromatic solvents.

Further, in the process as disclosed herein the recovered hydrocarbon stream containing a recycled catalyst (10*a*) is mixed with mixed feed stream and recycled back to slurry hydrocracking reactor (7). The recycled catalyst has metal sulfide particles.

In an embodiment of the present invention, the feed stream (1) is a vacuum residue comprises hydrocarbons having a boiling point of 500° C. and above, obtained from vacuum distillation unit.

In the present invention, the primary conversion unit (2) is a hydroconversion unit selected from at least one of a fixed bed hydroconversion unit, a moving bed hydroconversion unit, an ebullated bed hydroconversion unit, or a combination thereof. Optionally, the hydroconversion unit co-exists with a thermal cracking unit, a solvent extraction unit, and a combination thereof.

In an embodiment of the present invention, the hydroconversion unit co-exists with a thermal cracking unit, a solvent extraction unit, and a combination thereof.

In the present invention, the slurry hydrocracking reactor (7) is selected from at least one of a bubble column reactor, a tubular reactor, a loop reactor, and a combination thereof.

In the present invention, the slurry hydrocracking reactor (7) maximizes the conversions of mixed feed stream to distillate products and reduces the bottom unconverted fraction. The mixed feed stream is of high severity in terms of impurities and has high boiling material having boiling point above 500° C.

Further, lighter hydrocarbon fraction (3*a*) as recovered from a fractionator (3) includes a light naphtha, a heavy naphtha, kerosene, diesel, a light vacuum gas oil, and a heavy gas oil. The light naphtha and the heavy naphtha are hydrocarbon products obtained from atmospheric distillation column between temperature of 60-150° C. The light vacuum gas oil and the heavy gas oil are product of vacuum distillation column.

Further, the hydrocracked vacuum resid fraction (3*b*) as recovered from a fractionator (3) include hydrocarbons selected from an asphaltenic pitch, heavy de-asphalted oil, hydrocracked atmospheric tower or vacuum tower bottoms. The asphaltenic pitch is the residue pitch obtained after feed hydrocracking or bottom product of solvent de-asphalting process obtained from atmospheric and vacuum distillation unit and has high concentration of asphaltenes.

The hydrocracked vacuum resid fraction as described herein have boiling point above 500° C.

In an embodiment of the present invention the hydrocracked vacuum resid fraction (3*b*) comprises a metal selected from Ni and V in a range of 0 to 5000 ppm.

In a preferred embodiment of the present invention, the metal Ni and V is in a range of 10 to 1000 ppm.

In an embodiment of the present invention, the hydrocracked vacuum resid fraction (3*b*) has asphaltenes the in a range of 1 to 50 wt. % and a Conradson carbon residue (CCR) in a range of 1 to 60 wt. %

In a preferred embodiment of the present invention, the hydrocracked vacuum resid fraction (3*b*) has asphaltenes in a range of 3 to 30 wt. % and a Conradson carbon residue (CCR) in a range of 5 to 40 wt. %.

The mixed feed stream is processed in the slurry hydrocracking reactor (7) at a temperature in a range of 380 to 550° C., pressure in a range of 5 to 20 MPa, and liquid hourly space velocity in a range of 0.1 to 10 $hr^{-1}$.

In a preferred embodiment of the present invention, the mixed feed stream is processed in the slurry hydrocracking reactor (7) at a temperature in a range of 410 to 460° C., pressure in a range of 12 to 19 MPa, and liquid hourly space velocity in a range of 0.5 to 6 $hr^{-1}$.

In the present invention, the mixed feed stream has hydrogen to hydrocarbon in a ratio of 100 to 5000.

In a preferred embodiment of the present invention, the mixed feed stream has hydrogen to hydrocarbon in a ratio of 500 to 2000.

In the present invention, the catalyst dispersed in the mixed feed stream has a concentration in a range of 0.01 to 10 wt. %.

In a preferred embodiment of the present invention, the catalyst dispersed in the mixed feed stream has a concentration in a range of 0.05 to 5 wt. %.

In an embodiment of the present invention, the catalyst comprises a metal based oil soluble catalyst, an oil soluble metal sulfide catalyst, a nano particle supported catalyst, metal hexanoates, metal oxide based supports, and a combination thereof.

In an embodiment of the present invention, the catalyst comprises metal sulfide particles.

In another embodiment of the present invention, the catalyst is a mono metallic, a bimetallic or a trimetallic catalyst.

In another embodiment of the present invention, the mono metallic, the bimetallic or the trimetallic catalyst has a metal selected from a group such as molybdenum, nickel, tungsten, cobalt, iron, and a combination thereof.

In an embodiment of the present invention, the unconverted slurry hydrocracked pitch residue (9*d*) contains highly active catalyst metal sulfide particles with hydrocarbons having a boiling point above 540° C. and the same is recycled back to slurry hydrocracking reactor (7) to maximize the conversion.

In an embodiment of the present invention, the separator (8) is selected from a combination of high pressure high temperature (HPHT) separator, high pressure Low temperature (HPLT) separator, Low pressure high temperature (LPHT), separator and Low pressure low temperature (LPLT) separator. The said separator is used for separating liquids containing catalyst from the vapours.

In an embodiment of the present invention, the hydrogen is routed through a gas cooling system, then a hydrogen purification system, and finally recycle gas compression system to recycle the hydrogen.

In an exemplary embodiment, the gas cooling system comprises heat exchangers or air fin coolers.

In another exemplary embodiment, the hydrogen purification system comprises a membrane based hydrogen purification system.

In the present invention, the conversion of hydrocracked residual hydrocarbon (2*a*) in slurry hydrocracking reactor (7) is in a range of 90 to 99%.

In an embodiment of the present invention, processing the first stage hydrocracked residual hydrocarbon in slurry hydrocracking reactor (7) along with liquid recycle enhances residue conversions to greater than 97% with reduced high dense material/purge restricted to less than 3 wt. % which is utilized as a fuel in boilers or gasifiers for power generation, as an additive in cement industry, and as a fuel oil component after mixed with diluents.

In an embodiment of the present invention, the unconverted slurry hydrocracked pitch residue (9*d*) is recycled back to the slurry hydrocracking reactor (7) in a range of 10 to 95%, preferably about 90%.

In an embodiment of the present invention, the slurry hydrocracked bottom pitch (9*e*) is reduced in a range of 1 to 20%.

In a preferred embodiment of the present invention, the slurry hydrocracked pitch (9*e*) is reduced in a range of 1 to 5%.

In an embodiment of the present invention, the catalyst recycled to the slurry hydrocracking reactor (7) reduces the consumption of the catalyst in the range of 10 to 50%.

EXAMPLES

The present disclosure with reference to the accompanying examples describes the present invention. However, those of skill in the art should, in light of the present disclosure, appreciate that many changes can be made in the specific embodiments which are disclosed and still obtain a like or similar result without departing from the spirit and scope of the invention. It is understood that the examples are provided for the purpose of illustrating the invention only and are not intended to limit the scope of the invention in any way.

Comparative Example 1

Experiments of the present invention were carried out in a pilot scale slurry hydrocracking unit. Hydrocracked residue from a primary conversion unit was taken as a feed for this experiment and the properties of feed is shown in Table 1.

TABLE 1

| Feed properties | |
|---|---|
| Property | |
| Density, g/cc (@15.6° C.) | 1.064 |
| Sulfur, wt. % | 5.5 |
| CCR, wt. % | 33.6 |
| Asphaltene, wt. % | 21.4% |
| Metals (Ni + V), ppm | 350 ppm |

As a comparative example, the feed was first treated in a solvent extraction unit to remove an asphaltenic pitch stream and a deashphalted oil and further hydrocracked to get distillate products. In a second case as per the present invention, the feed was used directly without any treatment in slurry hydrocracking reactor with dispersed catalyst and hydrogen. The comparative example results are shown in Table 2.

TABLE 2

| Product | Comparative example Yield wt. % | Present invention Yield wt. % |
|---|---|---|
| Gas | 7.5 | 14.3 |
| Distillates | 40.3 | 54.5 |
| VGO | 27.1 | 28.3 |
| Unconverted residue after hydrocracking | 24.9 | 2.8 |

Conventional primary conversion hydrocracking unit integrated with solvent extraction process results ~75% conversion of virgin vacuum residue and result in high amount of hydrocracked residue ~25 wt. % of the feed.

Data provided in Table 2 shows that the amount of unconverted residue having boiling point above 500° C. after hydrocracking is 2.8% which makes it evident that slurry hydrocracking of hydrocracked residue showed improved overall conversion of greater than 97%. The distillates comprising hydrocarbon having six or above carbon atoms and boiling point of 370° C. has a yield of ~55 wt. % and VGO having boiling point in a range of 370° C. to 540° C. has a yield of 28.3 wt. %. From the results, the slurry hydroconversion process is very promising to integrate with existing low severity resid processing units in order to achieve higher conversions and distillate fuels.

We claim:

1. A process for upgradation of cracked residual hydrocarbons, the process consisting of:

i. hydrocracking a feed stream in a primary conversion unit to obtain a mix of a hydrocracked residual hydrocarbon stream and a lighter hydrocarbon stream, wherein the feed stream is a vacuum residue stream;

ii. sending the mix of the hydrocracked residual hydrocarbon and the lighter hydrocarbon stream into a fractionator to recover a lighter hydrocarbon fraction and a hydrocracked vacuum resid fraction;

iii. mixing the hydrocracked vacuum resid fraction having a boiling point of 540° C.+ with a diluent in the presence of hydrogen and a catalyst to form a mixed feed stream, wherein the catalyst is dispersed in the mixed feed stream;

iv. processing the mixed feed stream in a secondary conversion unit to obtain a stream of liquid effluents and vapour effluents, wherein the secondary conversion unit is a slurry hydrocracking reactor;

v. sending the stream of liquid effluents and vapor effluents into a separator to separate liquid effluents from vapour effluents;

vi. sending the liquid effluents to a fractionation column to separate a lighter distillate, a middle distillate, a vacuum gas oil, an unconverted slurry hydrocracked pitch residue, and a slurry hydrocracked bottom pitch, wherein the middle distillates are kerosene and diesel;

vii. recycling the unconverted slurry hydrocracked pitch residue to the slurry hydrocracking reactor, wherein the unconverted slurry hydrocracked pitch residue comprises the catalyst.

2. The process as claimed in claim 1, wherein the process further comprises step of sending the slurry hydrocracked bottom pitch to a catalyst recovery unit, wherein the slurry hydrocracked bottom pitch is mixed with the diluent to separate a recovered hydrocarbon stream comprising a recycled catalyst from a high dense material.

3. The process as claimed in claim 2, wherein the recovered hydrocarbon stream containing the recycled catalyst is mixed with mixed feed stream and recycled back to slurry hydrocracking reactor, wherein the recycled catalyst comprises metal sulfide particles.

4. The process as claimed in claim 1, wherein the diluent is selected from a group comprises clarified oil, vacuum gas oil (VGO), cycle oil, and aromatic solvents.

5. The process as claimed in claim 1, wherein the primary conversion unit is a hydroconversion unit selected from a fixed bed hydroconversion unit, a moving bed hydroconversion unit, an ebullated bed hydroconversion unit, and a combination thereof.

6. The process as claimed in claim 1, wherein the slurry hydrocracking reactor is selected from a bubble column reactor, a tubular reactor, a loop reactor, and a combination thereof.

7. The process as claimed in claim 1, wherein the lighter hydrocarbon fraction comprises light naphtha, heavy naphtha, kerosene, diesel, light vacuum gas oil, and heavy gas oil.

8. The process as claimed in claim 1, wherein the hydrocracked vacuum resid fraction comprises hydrocarbon having boiling point above 500° C., and a metal selected from Ni and V in a range of 0 to 5000 ppm.

9. The process as claimed in claim 8, wherein the metal Ni and V is in a range of 10 to 1000 ppm.

10. The process as claimed in claim 1, wherein the hydrocracked vacuum resid fraction has asphaltenes in a range of 1 to 50 wt. % and a Conradson carbon residue (CCR) in a range of 1 to 60 wt. %.

11. The process as claimed in claim 10, wherein the hydrocracked vacuum resid fraction has asphaltenes in a range of 3 to 30 wt. % and a Conradson carbon residue (CCR) in a range of 5 to 40 wt. %.

12. The process as claimed in claim 1, wherein the mixed feed stream is processed in the slurry hydrocracking reactor at a temperature in a range of 380 to 550° C., pressure in a range of 5 to 20 MPa, liquid hourly space velocity in a range of 0.1 to 10 $hr^{-1}$.

13. The process as claimed in claim 12, wherein the mixed feed stream is processed in slurry hydrocracking reactor at a temperature in a range of 410 to 460° C., pressure in a range of 12 to 19 MPa, liquid hourly space velocity is in a range of 0.5 to 6 $hr^{-1}$.

14. The process as claimed in claim 1, wherein the mixed feed stream has hydrogen to hydrocarbon in a ratio of 100 to 5000.

15. The process as claimed in claim 1, wherein the catalyst in the slurry hydrocracking reactor has a concentration in a range of 0.01 to 10 wt. %.

16. The process as claimed in claim 1, wherein the catalyst comprises a metal based oil soluble catalyst, an oil soluble metal sulfide catalyst, a nano particle supported catalyst, metal hexanoates, metal oxide based supports, and a combination thereof.

17. The process as claimed in claim 16, wherein the catalyst is a mono metallic, a bimetallic or a trimetallic catalyst; wherein the mono metallic, the bimetallic or the trimetallic catalyst comprises a metal selected from molybdenum, nickel, tungsten, cobalt, iron, and a combination thereof.

18. The process as claimed in claim 1, wherein the unconverted slurry hydrocracked pitch residue is recycled back to the slurry hydrocracking reactor in a range of 10 to 95%.

19. The process as claimed in claim 1, wherein the catalyst recycled to the slurry hydrocracking reactor reduces the consumption of the catalyst in a range of 10 to 50%.

* * * * *